United States Patent [19]

Addair

[11] Patent Number: 4,611,804

[45] Date of Patent: Sep. 16, 1986

[54] MATTRESS EXERCISE APPARATUS

[76] Inventor: George W. Addair, 334 W. Medlock, Phoenix, Ariz. 85013

[21] Appl. No.: 477,211

[22] Filed: Mar. 21, 1983

[51] Int. Cl.[4] ..... A63B 21/00

[52] U.S. Cl. ..... 272/126; 5/445

[58] Field of Search ..... 272/135-139, 272/144, 126, 900; 5/445, 496, 498, 508, 494, 466; 128/DIG. 15, 134, 25 R

[56] References Cited

U.S. PATENT DOCUMENTS

| | | | |
|---|---|---|---|
| 1,746,111 | 2/1930 | Fisher | 272/126 |
| 2,284,778 | 6/1942 | Treiber | 5/498 |
| 2,335,290 | 11/1943 | Medaris | 272/126 |
| 2,459,497 | 1/1949 | Calabro | 5/498 |
| 2,677,834 | 5/1954 | Moynihan | 128/134 |
| 2,923,014 | 2/1960 | Hume | 5/498 |
| 3,323,150 | 6/1967 | Rehder | 128/134 |
| 3,817,245 | 6/1974 | Kroeger | 128/134 |
| 4,186,453 | 2/1980 | Burns et al. | 5/494 |
| 4,276,667 | 7/1981 | Osbourne | 5/498 |

*Primary Examiner*—Richard J. Apley
*Assistant Examiner*—S. R. Crow
*Attorney, Agent, or Firm*—Drummond & Nissle

[57] ABSTRACT

Exercise apparatus adapted to be detachably installed on a mattress without having to adapt or alter the construction of the mattress or bed frame carrying the mattress. The apparatus is readily utilized by an individual reclining on the mattress.

7 Claims, 3 Drawing Figures

FIG. 1
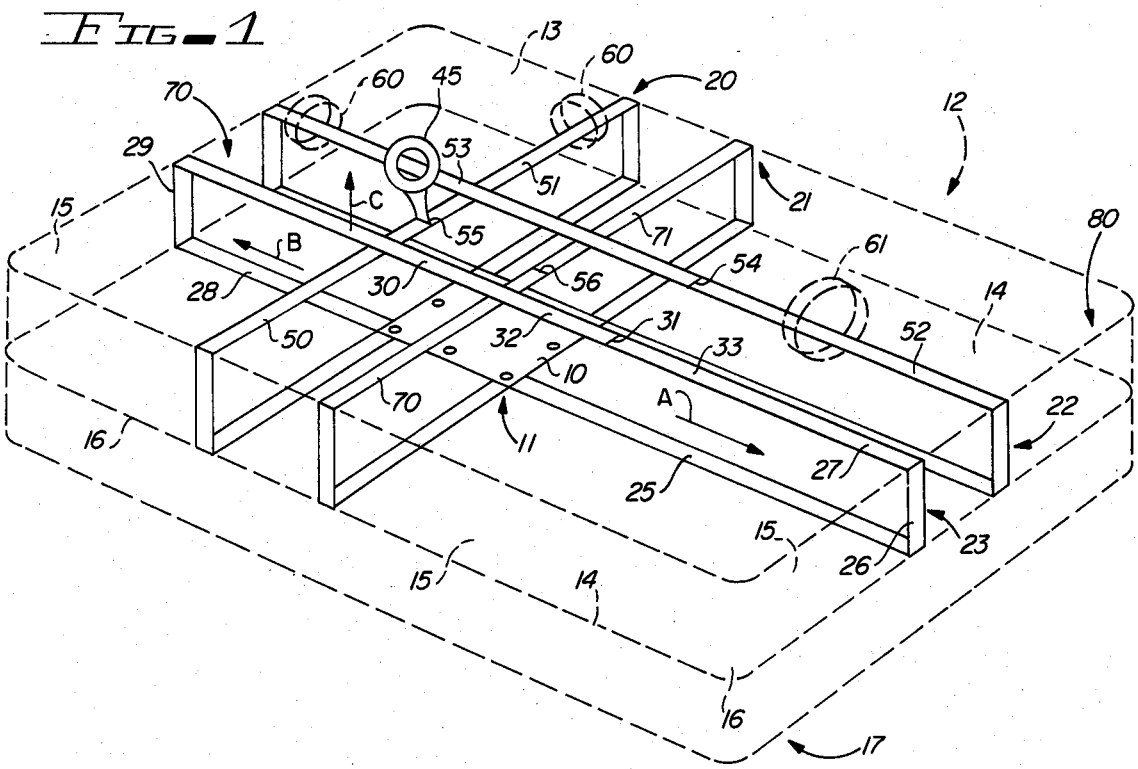
FIG. 2
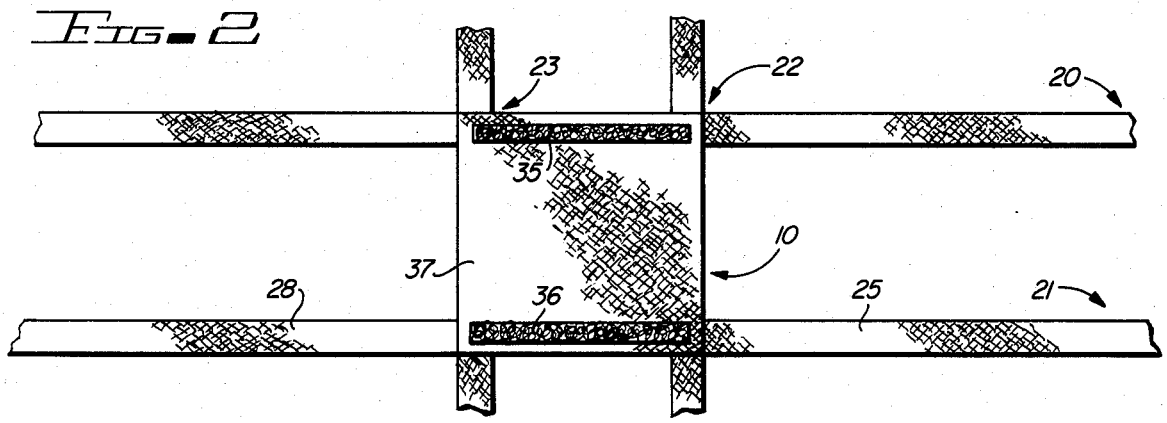
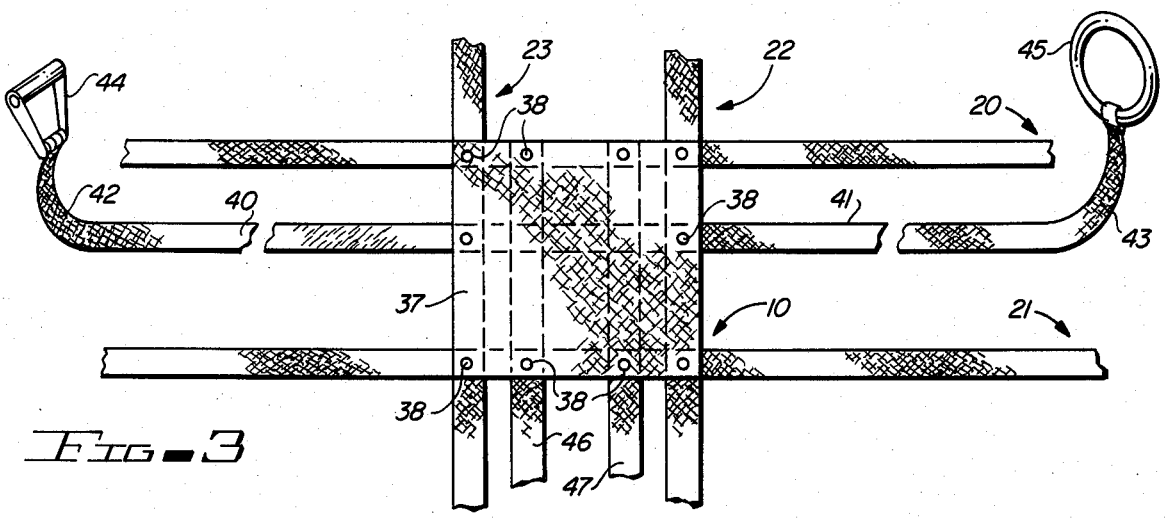
FIG. 3

MATTRESS EXERCISE APPARATUS

This invention pertains to exercise apparatus.

More particularly, the invention concerns exercise apparatus which enables an individual to perform simple exercises while in bed.

In a further and more specific respect, the invention relates to exercise apparatus which can be readily installed on a mattress and utilized by an individual reclining on the mattress without requiring that the apparatus be sewn or otherwise secured to the mattress.

In another respect, the invention pertains to exercise apparatus of the type described which, when force is applied to the apparatus by an individual during use of the apparatus, tends to maintain its proper operative position on the mattress.

In a further respect, the invention relates to mattress exercise apparatus which can, without the aide of a medical attendant, often be utilized by handicapped individuals.

Periodic moderate exercise has long been recommended as one of the principal ingredients necessary for maintaining good health. When an individual convalescing in bed is unable to exercise, his muscles gradually atrophy and he is more likely to develop bed sores and become susceptible to a variety of other diseases.

One reason exercise is generally not attempted by bedridden individuals is that most conventional exercise equipment is simply not adapted or appropriate for use by bedridden patients. Since conventional exercise equipment is designed for use by completely healthy individuals, use of the equipment by convalescing individuals would require an excessive amount of exertion. Further, in many instances, particularly when handicapped individuals are involved, conventional exercise equipment cannot be utilized by a bedridden individual unless the equipment is specially adapted for use on a bed and one or more medical attendants assist the individual during use of the equipment. Adapting existing exercise equipment for a bed and providing attendants to assist in the use of the equipment is expensive and time consuming. Consequently, bedridden individuals often do not attempt to perform even the simplest of exercises.

Accordingly, it would be highly desirable to provide improved exercise apparatus which could, with little or no assistance from medical attendants, be readily installed in operative position on a bed and be utilized by bedridden individuals to perform simple exercises.

It would also be highly desirable to provide improved exercise apparatus which was of lightweight and simple construction and which could be easily utilized by handicapped persons having normal control over portions of their musculature.

Therefore, it is a principal object of the invention to provide improved exercise apparatus for use by individuals while reclining in bed.

A further object of the invention is to provide improved exercise apparatus which can, with minimal or no assistance from medical attendants, be readily utilized by bedridden individuals.

Another object of the instant invention is to provide improved exercise apparatus which is lightweight, of compact storage, and which can be quickly and conveniently installed in operative position on a bed without the use of hand tools or other equipment.

Still a further object of the present invention is to provide improved exercise apparatus which can be readily adapted for and utilized by persons of varying height and physical condition and which can be adapted to vary the resistance the apparatus provides during the performance of an exercise.

These and other, further and more specific objects and advantages of the invention will be apparent to those skilled in the art from the following detailed description thereof, taken in conjunction with the drawings, in which:

FIG. 1 is a perspective view of exercise apparatus constructed in accordance with the invention and installed in operative position on a mattress;

FIG. 2 is a top view of the exercise apparatus of FIG. 1 provided with means for fixedly securing the apparatus in position beneath a mattress; and FIG. 3 is a top view of the exercise apparatus of FIG. 1 provided with straps having one end adapted to be manually or pedally grasped.

Briefly, in accordance with my invention, I provide improved exercise apparatus for use in combination with mattress means. The mattress means includes a generally horizontally oriented upper surface for receiving and supporting a reclining individual; a generally horizontal bottom surface; and, a peripheral side surface spanning the distance between and generally circumscribing the top and bottom surfaces of the mattress means. The bottom surface of the mattress means rests on a support surface. The improved exercise apparatus includes a pad positioned between the bottom surface of the mattress means and the support surface and elongate strap means connected to the pad and including a first strap and a second strap. The first strap includes a first segment attached to the pad and extending in a first direction between the bottom surface and support surface to the peripheral side surface; a second segment attached to the first segment and extending upwardly along the peripheral side surface; and, a third segment attached to the second segment and extending over the upper surface. The second strap includes a first portion attached to the pad and extending in a second direction between the bottom surface and the support surface to the peripheral side surface; a second portion attached to the first portion and extending upwardly along the peripheral side surface; and, a third portion attached to the second portion and extending over the upper surface. The first direction is generally opposite the second direction such that when a first force applied to the third segment in the second direction and a second force applied to the third portion in the first direction respectively cause resultant tensile forces in the first and second segments and in the first and second portions, the tensile forces in the first portion generally act in a direction opposite the tensile forces in the first segment and tend to maintain the pad between the bottom surface and the support surface.

Turning now to the drawings, which depict the presently preferred embodiments of the invention for the purpose of illustrating the practice thereof and not by way of limitation of the scope of the invention and in which like reference characters represent corresponding elements throughout the several views, FIG. 1 illustrates the presently preferred embodiment of the invention generally indicated by reference character 11 and installed on mattress 12 including upper generally horizontal surface 13, lower generally horizontal surface 14, and peripheral side surface 15 spanning the distance between and circumscribing upper surface 13 and lower surface 14. Lower surface 14 of mattress 12 is received and supported by generally horizontal surface 16 of bed spring 17. As utilized herein, the term mattress may signify a single mattress, a plurality of stacked mattresses, a single mattress and bed spring combination, or a plurality of mattresses and/or bed springs stacked such that a mattress is at the top of the stack.

Exercise apparatus 11 includes pad 10 which is positioned between bottom surface 14 of mattress 12 and support surface 16 of box spring 17. Straps 20–23 are attached to pad 10 and generally encircle mattress 12. Although straps 20–23 are elastic in the presently preferred embodiment of the invention, straps 20–23 may be formed from any desired elastic or non-elastic material and, may be relatively continuous strips of material as pictured in FIG. 1, may be comprised of pieces of material linked in the fashion of a chain, or may be otherwise formed. Straps 20–23 may be cylindrical or of any other shape and may be much wider than they are depicted in the drawings.

Strap 23 includes a first segment 25 connected to pad 10 and extending in the direction indicated by arrow A between lower surface 14 of mattress 12 and upper surface 16 of box spring 17 to peripheral wall 15 of mattress 12. Second segment 26 of strap 23 is attached to segment 25 and extends over and along peripheral surface 15 to segment 27. Third segment 27 is connected to segment 26 and extends over upper surface 13 of mattress 12. First portion 28 of strap 23 is attached to pad 10 and extends in the direction indicated by arrow B between lower surface 14 of mattress 12 and support surface 16 of box spring 17 to peripheral surface 15. Second portion 29 of strap 23 is attached to portion 28 and extends upwardly along peripheral surface 15 of mattress 12 to portion 30. Third portion 30 is attached to second portion 29 and extends over upper surface 14 of mattress 12. Although third portion 30 is connected to third segment 27 at seam 31 in FIG. 1, portion 30 and segment 27 need not be connected. Instead, end 32 of portion 30 and end 33 of segment 27 could each be attached to a ring or other means which can be conveniently manually grasped. End 32 and end 33 could also each be adapted to be engaged with or connected to various parts of an individual's body.

As indicated in FIG. 1, the portions of straps 20–23 which are positioned above surface 13 include segments 27, 52, 53, 50, 51, 70, 71 and 30. Segments 50, 51 are connected along seam 55; and, segments 70, 71 along seam 56.

In FIG. 1, pad 10 is positioned between but is not secured to bottom surface 14 of mattress 12 or upper horizontal support surface 16 of box spring 17. When strap 23 is elasticized, it is sized so it must be partially stretched when pad 10 is positioned beneath mattress 12 and strap 23 positioned around mattress 12 as shown in FIG. 1. When strap 23 is partially stretched as shown in FIG. 1, the tensile force acting along segment 25 in the direction of arrow A is at least somewhat offset by the tensile force acting along portion 28 in the direction of arrow B such that pad 12 tends to remain in its operative position between mattress 12 and box spring 17. If segment 33 or portion 30 of strap 23 is deflected upwardly in the direction of arrow C in FIG. 1 or is otherwise deflected such that the tensile forces respectively acting on segment 25 and portion 28 in the directions of arrows A and B are increased, the increased tensile forces acting in directions A and B still tend to offset one another so that pad 12 remains positioned between mattress 12 and bed spring 17. When a plurality of elastic or non-elastic straps are attached to pad 10 as in FIG. 1, the weight of mattress 12 against the portions of straps 20–23 sandwiched between lower surface 14 and support surface 16 develops frictional forces which tend to resist movement of the sandwiched strap portions and tend to maintain pad 10 in position between mattress 12 and box spring 17. Similar frictional forces between pad 10 and surfaces 14 and 16 also tend to prevent pad 10 from sliding from its operative position of FIG. 1.

The size of pad 10 can be varied as desired. The presently preferred area of upper surface 37 or of the lower surface of pad 10 is approximately four to nine square feet. The ability of pad 10 to remain in position during utilization of the exercise apparatus can be increased by simply enlarging pad 10 and thus increasing the pad surface area in contact with surfaces 14, 16. If the area of the upper or lower planar surface area of pad 10 were one-fourth to one-half of the area of surface 14 or 16, the weight of mattress 12 would make it particularly difficult to displace pad 10 when any of segments 27, 52, 53, 50, 51, 70, 71 or 30 were being stretched or pulled during use of the apparatus.

To further anchor pad 10 beneath mattress 12, negative Velcro strips 35, 36 can, as shown in FIG. 2, be attached to top surface 37 of pad 10. Positive Velcro strips opposing strips 35, 36 would be attached to bottom surface 14 of mattress 12. Velcro strips could similarly be attached to the bottom surface of pad 10 and to surface 16 of bed spring 17. In place of Velcro, snaps 38 could, as shown in FIG. 3, be attached to upper surface 37 of pad 10. Mates for snaps 38 would be secured to bottom surface 14 of mattress 12. Snaps and mates for the snaps could be similarly provided for the bottom surface of pad 10 and surface 16 of bed spring 17. Any other desired attachment means could be utilized to permanently secure or detachably fixedly secure pad 10 to surface 14 and/or 16.

In FIG. 3, pad 10 is provided with additional straps 40, 41 which each extend from pad 10 between mattress 12 and box spring 17 to peripheral surface 15 and extend upwardly along surface 15 and over upper surface 13 of mattress 12. Ends 42, 43 of straps 40, 41 are positioned over surface 13 and provided with manual grasps 44, 45. Straps 46, 47 extend from pad 10 in a direction generally parallel to straps 22, 23. Although not shown in FIG. 3, straps 46, 47 extend to peripheral surface 15, upwardly along surface 15 and over upper surface 13 of mattress 12. The ends of straps 46, 47 positioned over surface 13 are attached to stirrups into which an individual's feet can be inserted. Once an individual's feet are inserted in the stirrups, he can attempt to bend his knees and pull the stirrups toward his chin.

In use, after pad 10 and straps 20–23 are positioned on mattress 12 as shown in FIG. 1, an individual reclines on mattress 13 either on or beneath the portions of straps 20–23 positioned above surface 13 of mattress 12. The head of the individual is on upper end 70 of mattress 12 while his feet are on lower end 80 of mattress 12.

When an individual is positioned on top of the portion of straps 20–23 located over surface 13 he can grasp portions 50, 51 of strap 20 with his hands and pull strap 20 upwardly away from surface 13 to exercise his arm and back muscles. He can also slide one foot between segment 27 and mattress 12 and his other foot between segment 52 and mattress 12. After his feet are beneath segments 27, 52, he can, to exercise his leg muscles, attempt to lift his feet upwardly against the resistance supplied by straps 22, 23.

If an individual were to position himself between straps 20–23 and mattress 12, he could similarly grasp or wrap his hand, wrist, ankle or foot around one of continuous straps 20–23 and attempt to move his arms or legs in a direction which would be resisted by the straps. Once an individual is positioned above or beneath the portions of straps 20–23 which are over surface 13, grasping or engaging the straps normally requires very little effort on the part of the individual.

In FIG. 3, the ends of straps 40, 41 are provided with manually grasped rings 44, 45. The ends of straps 40, 41, or any portion of any of the other strap segments positioned above surface 13, can be adapted to fit around or engage any body member. For instance, in FIG. 1, loop 60 attached to strap 22 is sized to receive the forearm of a person while loop 61 is sized to receive the leg of an individual. Any of strap portions 42, 43, 50, 51, 70, 71, 27, 30, 52, 53 could be adapted to detachably engage an individual's waist, chest, neck, head, etc.

In FIG. 1, straps 20–23 completely span upper surface 13 of mattress 12. As indicated in FIG. 3, pad 10 can be provided with straps 40, 41 which do not completely span surface 13 but have a free end 42, 43 which lies on surface 13. When a strap does not completely span surface 13, the length of strap on surface 13 depends on factors such as how the end of the strap is adapted to engage an individual's body, the particular portion of an individual's body intended to engage the strap, and the size of the person utilizing the exercise apparatus.

To facilitate the adapting of the exercise apparatus of the invention to mattresses and individuals of differing size, the apparatus can be provided with a plurality of straps which could be readily connected to and detached from pad 10. Straps of differing lengths and elasticity can be included. Rings, fabric loops and other body engaging means which can be readily connected to and removed from the straps at various points along their lengths can also be provided. Some of the straps would be intended to completely encircle a mattress as do straps 20–23 in FIG. 1. Other straps would have one end connected to pad 10 and the other free end positioned on top of surface 13 of mattress 12.

Pad 10 can be constructed to be folded into and secured in different sized configurations so that the amount of surface area between pad 10 and mattress 12 can be adjusted. Means can be provided for adapting pad 10 and mattress 12 or box spring 17 so pad 10 can be detachably fixedly secured thereto.

Having described my invention in such terms as to enable those skilled in the art to understand and practice it, and having identified the presently preferred embodiments thereof, I claim:

1. In combination with a bed including
- a mattress including
  - a generally horizontal upper surface for receiving and supporting a reclining individual,
  - a generally horizontal bottom surface, and
  - a peripheral side surface spanning the distance between and generally circumscribing said top and bottom surfaces,
- a support surface beneath and contacting said bottom surface of said mattress, exercise apparatus including (a) a pad positioned between said bottom surface of said mattress and said support surface and including an upper surface contacting said bottom surface of said mattress, the area of said upper surface of said pad being less than the area of said bottom surface of said mattress, and (b) elongate strap means connected to said pad and including
- (i) a first strap including
  - a first segment attached to and extending from said pad in a first direction between said bottom surface and said support surface to said peripheral side surface,
  - a second segment extending upwardly along said peripheral side surface, and
  - a third segment extending over said upper surface,
- (ii) a second strap including
  - a first portion attached to and extending from said pad in a second direction between said bottom surface and said support surface to said peripheral side surface,
  - a second portion extending upwardly along said peripheral side surface, and
  - a third portion extending over said upper surface,
- (iii) a third strap including
  - a first segment attached to and extending from said pad in a third direction between said bottom surface and said support surface to said peripheral side surface,
  - a second segment extending upwardly along said peripheral side surface, and
  - a third segment extending over said upper surface, and
- (iv) a fourth strap including
  - a first portion attached to and extending from said pad in a fourth direction between said bottom surface and said support surface to said peripheral side surface,
  - a second portion extending upwardly along said peripheral side surface, and
  - a third portion extending over said upper surface;

said first direction generally being opposite and parallel said second direction;

said third direction generally being opposite and parallel said fourth direction, said third and fourth straps being generally perpendicular to said first and second straps and said third and fourth directions being generally perpendicular to said first and second directions;

an individual utilizing said exercise apparatus by reclining on said upper surface of said mattress and utilizing a portion of his body to engage and
- outwardly displace away from said upper surface, or
- pull on at least one of
- said third segment of said first strap,
- said third portion of said second strap,
- said third segment of said third strap, and
- said third portion of said fourth strap, at least one of said third segments and third portions includes handle means which enable said individual to manually grasp said handle means and pull on said one of third segments and third portions.

2. The combination of claim 1 wherein at least one of said strap segments and portions is elastic.

3. The combination of claim 1 wherein at least one of said straps is elastic.

4. The combination of claim 1 wherein said pad is adapted to be folded into and secured in each of a plurality of configurations, said area of said upper surface of said pad differing in each of said configurations.

5. The combination of claim 1 wherein at least one of
(a) a first pair comprising said third segment of said first strap and said third portion of said second strap, and
(b) a second pair comprising said third segment of said third strap and said third portion of said fourth strap,
is interconnected and spans said upper surface of said mattress.

6. The combination of claim 5 wherein at least one of said first and second pair includes handle means adapted to permit an individual to grasp said handle means and pull on said one of said first and second pair.

7. The combination of claim 6 wherein said pad includes means for fixedly detachably securing said pad to at least one of said bottom surface of said mattress and said support surface.

* * * * *